US006196387B1

(12) United States Patent
Hsi-Chang

(10) Patent No.: US 6,196,387 B1
(45) Date of Patent: Mar. 6, 2001

(54) FOLDED CARDBOARD ARTICLE FOR PACKAGING WESTERN SPURS

(75) Inventor: Chang Hsi-Chang, Taichung (TW)

(73) Assignee: Eastwest International (Taiwan) Enterprises, Taichung (TW)

( * ) Notice: Subject to any disclaimer, the term of this patent is extended or adjusted under 35 U.S.C. 154(b) by 0 days.

(21) Appl. No.: 09/325,089

(22) Filed: Jun. 3, 1999

Related U.S. Application Data

(63) Continuation of application No. 09/003,448, filed on Jan. 6, 1998, now Pat. No. 5,975,294.

(51) Int. Cl.[7] ..... A45C 11/26
(52) U.S. Cl. ..... 206/349; 206/485; 206/526
(58) Field of Search ..... 206/349, 353, 206/485, 526, 784, 493, 315.1, 463, 464, 471; 53/397, 409

(56) References Cited

U.S. PATENT DOCUMENTS 2,950,854 8/1960 Ganz .
3,198,378 8/1965 Farquhar .
4,046,251 9/1977 Bruml .
4,191,289 3/1980 Austin .
4,518,086 5/1985 Roccaforte .

*Primary Examiner*—Paul T. Sewell
*Assistant Examiner*—Shian Luong
(74) *Attorney, Agent, or Firm*—Antonio R. Durando

(57) ABSTRACT

A single-piece cardboard sheet into which slots and tabs are strategically cut to permit its folding into a carton for packaging a pair of western spurs. The unfolded carton is substantially symmetrical with respect to both its major and minor axes and comprises a bottom section from which two pairs of largely equal structural segments (a front and a back section) project outwards along the longitudinal axis. A cut at the boundary between the bottom section and each of these structural segments defines an extension sufficiently large to support the tips of the sides of the two spurs. The front section of the cardboard carton contains a cut that defines a substantially rectangular tab and a corresponding opening suitable for passing the sides of two spurs therethrough. The top of the front section also contains a hanging slot suitable for receiving the hook of a display rack. The back section of the carton contains the same features symmetrically arranged with respect to the bottom section, such that they substantially match when both sections are folded upward from the bottom section. The distal end of the front section includes a winged tab and the distal end of the back section includes two foldable flaps such that each flap can be bent over a wing of the tab and provide a fastening mechanism for the entire structure when the carton is folded and the packaging assembly is completed.

16 Claims, 5 Drawing Sheets

FOLDED CARDBOARD ARTICLE FOR PACKAGING WESTERN SPURS

RELATED APPLICATIONS

This is a continuation application of U.S. Ser. No. 09/003,448, filed by the same inventor on Jan. 6, 1998, now U.S. Pat. No. 5,975,294.

BACKGROUND OF THE INVENTION

1. Field of the Invention

This invention is related in general to the field of packaging and displaying of commercial articles. In particular, the invention consists of a novel cardboard carton for packaging and displaying western-style riding spurs.

2. Description of the Related Art

It is desirable to package and market products such that they are visible and easily placed on a shelf, preferably hanging from a display hook. In addition, it is desirable to package them in a relatively inexpensive container or carton. In the case of riding spurs, it is also necessary that the packaging allow a potential buyer the opportunity to touch and feel the spurs, and try them on the footwear for which they are intended. Accordingly, it is important that the package be suitable for easy opening and removal of the spurs, and further for easy reassembly into an undamaged package.

Products are often packaged in folded cardboard structures especially designed for the task at hand. In such cases, the carton is produced by shaping a flat cardboard sheet to fit the dimensions of the article to be packaged and by cutting appropriate tabs and slots to form the carton around the article. The present invention relates to a novel cardboard structure for packaging a pair of western-style spurs.

A spur is a pointed device secured to a rider's boot heel to urge on a horse. Typically, western spurs consist of a wishbone structure that includes a U-shaped heel band consisting of a curved portion (often called shoulders) with substantially straight ends or sides that include buttons for mounting on the heel of a boot, and a neck protruding outwardly from the shoulders. Western spurs also contain a rowel rotatably attached to the tip of the neck. Because of this geometry, spurs are not conveniently suitable for hanging on a display rack. Thus, they are usually displayed in plastic bags or loosely on a rack.

Therefore, it would be desirable to have an inexpensive and practical packaging cardboard structure for containing and displaying a pair of western spurs visibly on a shelf. This invention is directed at a simple device for achieving that purpose.

BRIEF SUMMARY OF THE INVENTION

One primary goal of this invention is a cardboard structure for packaging a pair of western spurs for display on a shelf or a rack.

Another goal of the invention is a packaging structure that is folded around a pair of spurs to form a package suitable for display.

Another objective is a package that can be assembled around a pair of spurs simply and quickly.

Finally, an objective of the invention is a device that is inexpensively manufactured from material readily available in commerce, preferably cardboard.

Therefore, according to these and other objectives, the present invention consists of a piece of cardboard sheet or equivalent material into which slots and tabs are strategically cut to permit its folding into a carton for packaging a pair of western spurs. The unfolded cardboard carton is substantially symmetrical with respect to both its major and minor axes and comprises a central or bottom section from which two pairs of largely equal structural segments (a front and a back section) project outwards along the longitudinal axis. A cut at the boundary between the bottom section and each of these structural segments defines an extension sufficiently large to support the tips of the sides of the two spurs. The front section of the cardboard carton contains a cut that defines a substantially rectangular tab and a corresponding opening suitable for passing the sides of two spurs therethrough. The top of the front section also contains a hanging slot suitable for receiving the hook of a display rack. In addition, an opening below the hanging slot may be provided for visual access. The back section of the carton contains the same features symmetrically arranged with respect to the bottom section, such that they substantially match when both sections are folded upward from the bottom section. Finally, the distal end of the front section includes a winged tab and the distal end of the back section includes two foldable flaps such that each flap can be bent over a wing of the tab and provide a fastening mechanism for the entire structure when the carton is folded and the packaging assembly is completed.

A pair of spurs can be packaged together in the carton of the invention standing side by side straddled over the openings in the front and back sections. These sections are first folded upward, thereby forming a base consisting of the bottom section and its extensions. The rectangular tabs in both sections are folded inward and the corresponding rectangular openings are used to engage the sides of the spurs, each spur with one side protruding toward the front and the other side toward the back of the carton with the side tips resting on the base extensions. The front and back sections are brought together and the rectangular tabs are overlapped, thereby sandwiching the necks and rowels of the spurs. Finally, the foldable flaps in the distal end of the back section are folded to latch onto the winged tab of the front section to fasten the carton into a unit. The resulting assembly is a pair of spurs firmly packaged in a cardboard carton for shipment and display.

Thus, spurs packaged according to the invention are visible (FIG. 2), accessible for touching while still within the package, and easily removable from the carton to establish whether they fit a buyer's footwear. Once taken apart, the carton can be reused to repackage the spur easily and without damage, if necessary.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose but one of the various ways in which the invention may be practiced.

DESCRIPTION OF THE PREFERRED EMBODIMENTS OF THE INVENTION

This invention is based on the idea of utilizing a single-piece cardboard structure to produce a foldable carton suitable for advantageously packaging and displaying a pair of western spurs. The design of the cardboard article makes it possible to encase the spurs in a single package simply by folding the article's front and back sections while inserting each end of the spurs in apposite receiving openings and using a winged tab and cooperating foldable flaps to latch the sections into an assembled package.

Figure 1:
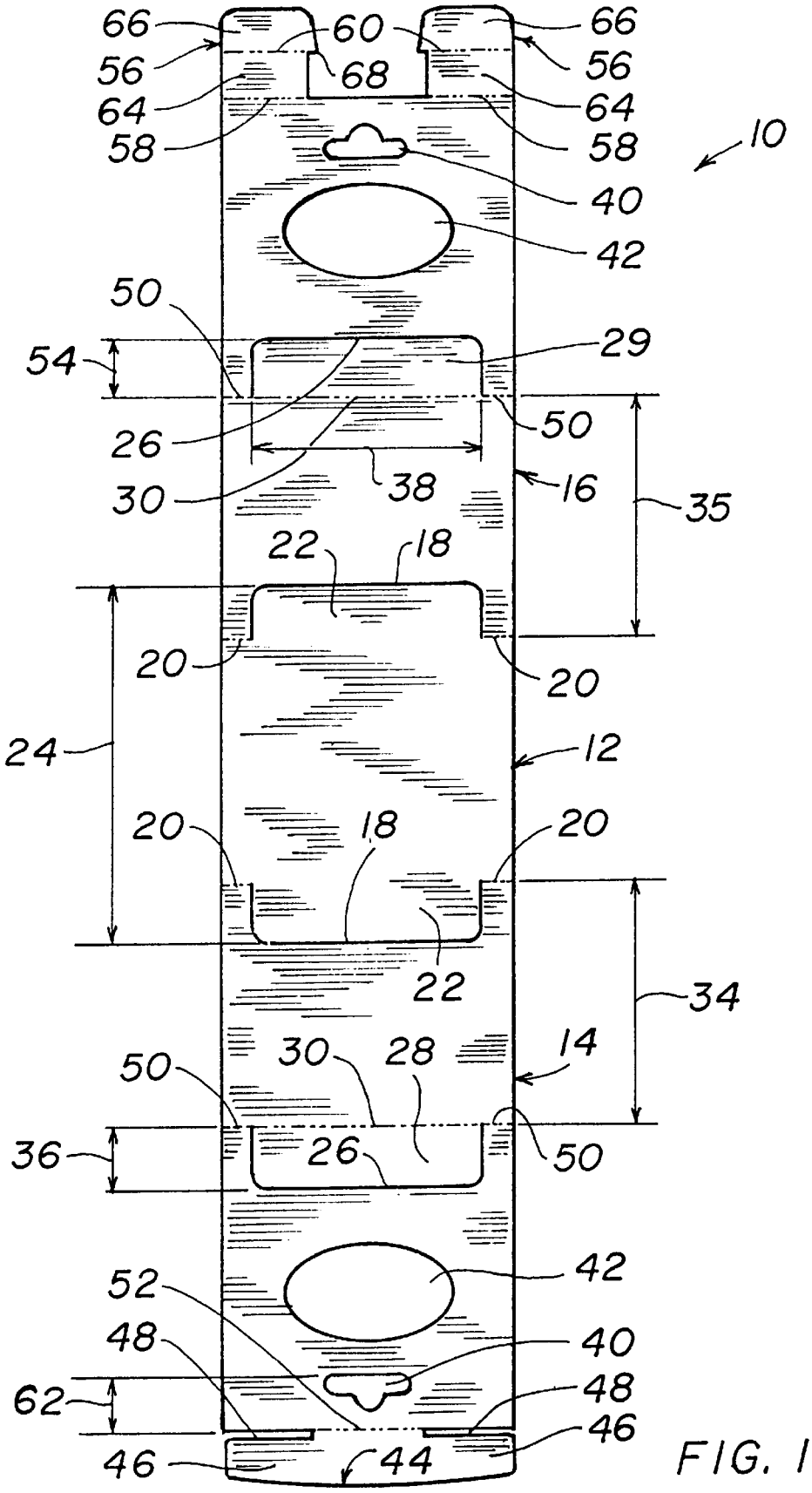
FIG. 1 is a plan view of a flat cardboard sheet cut to obtain a foldable packaging carton according to the preferred embodiment of the invention.
Figure 2:
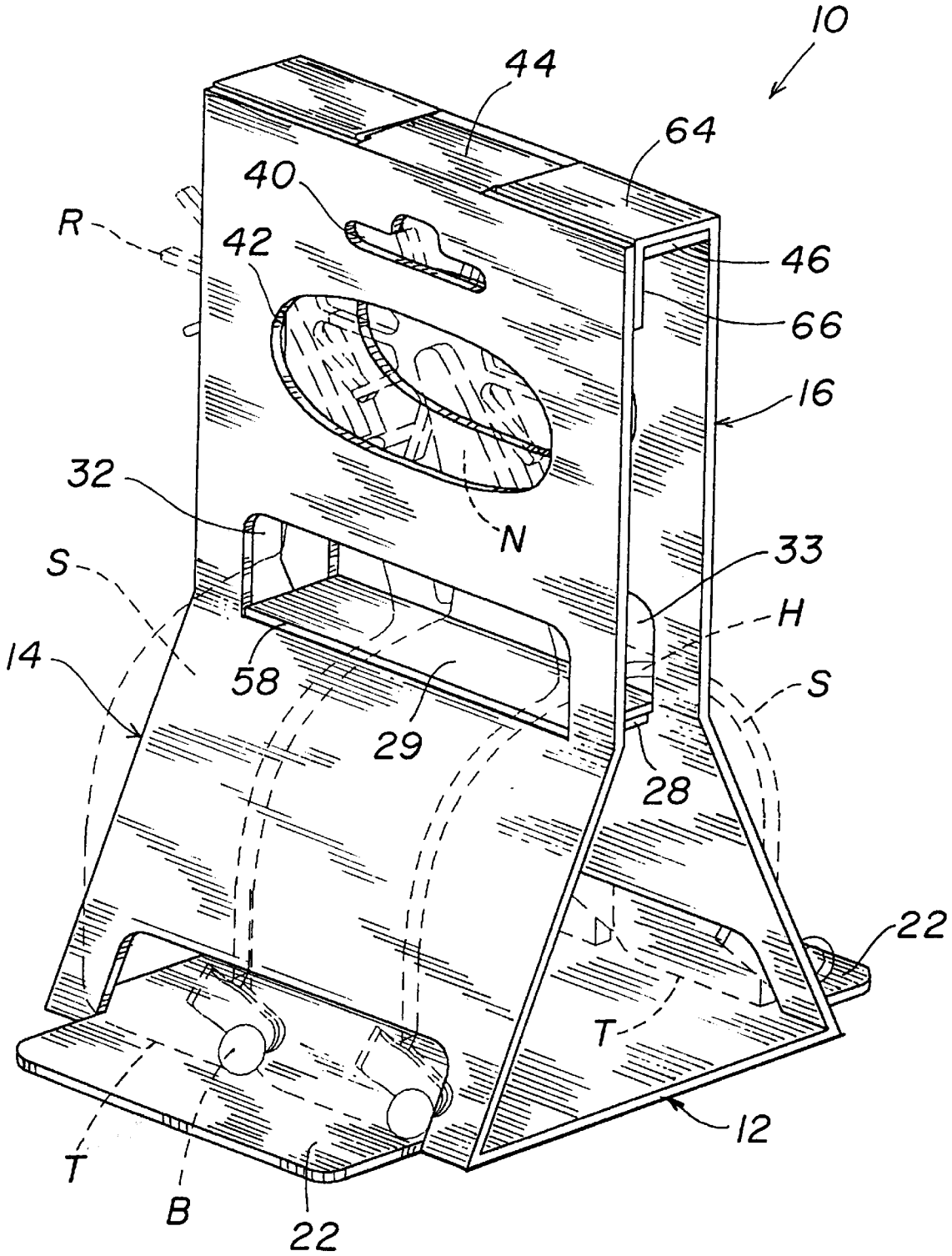
FIG. 2 is a perspective view of the carton of the invention after folding around a pair of western spurs to produce a packaged product.

Referring to the figures, wherein like parts are designated by like reference numerals and symbols, FIG. 1 is a plan view of an unfolded cardboard packaging article or carton 10 according to the invention. The carton consists of a substantially rectangular structure comprising three distinct sections that are folded to wrap around a pair of spurs for packaging for distribution. The boundaries of a central or bottom section 12 with a lower or front section 14 and an upper or back section 16 are defined by an approximately rectangular cut 18 and two lateral fold lines 20. Since the bottom section 12 is intended to provide a base for the carton of the invention upon upward folding of the front and back sections along first fold lines 20, the cuts 18 delineate two extensions 22 that expand the base and provide a support structure for the tips T of the sides S of the upright spurs packaged in the carton, as illustrated in FIG. 2. Therefore, the total length 24 of the base section 12, including the extensions 22, must be at least equal to the width of the spurs at the tips of their sides. The front section 14 (shown as the bottom section in the unfolded plan view of FIG. 1) of the article 10 includes a substantially rectangular cut 26 that produces a tab 28 that is foldable along a second fold line 30 to form a corresponding opening 32 (see FIG. 2). The opening 32 is provided to receive the sides S of two spurs packaged side by side with their end tips resting on the base extensions 22; therefore, the distance 34 between the base 12 and the lower side of the openings 32 must approximate the height of the heel band H in the spurs for which the carton is intended. Also, the height 36 and width 38 of the opening 32 (and correspondingly of the tab 28) must be sufficient to accommodate the thickness of two heel bands H straddled across the opening 32 and of their necks N sandwiched between the front and back sections 14, 16. Note that the tab 28 and an equivalent tab 29 in the back section 16 (defining a corresponding opening 33) are folded and overlapped to establish a separation between the front and back sections in the folded carton and to provide a support for the shoulders H of the spurs straddled across them in the packaged unit. The front section 14 further includes a hanging slot 40 suitable for connection with a hook or other engaging member typically found in a display rack. The slot 40 is preferably positioned in the distal portion of the section such that it clears the rowels R of the spurs after the section is folded to form the package (as seen in FIG. 2) and becomes available for engagement by such a hook. The front section 14 may also include a display opening 42, shown in oval shape in the figures, to allow viewing of the rowel and neck portions of the spurs by a potential buyer. Finally, the distal end of the front section 14 includes a winged tab 44 comprising wings 46 separated from the rest of the section by two lateral slits 48. Additional third and fourth fold lines 50 and 52 are provided for forming the front section 14 into a retaining structure during the process of packaging the spur, as described below.

Figure 3:
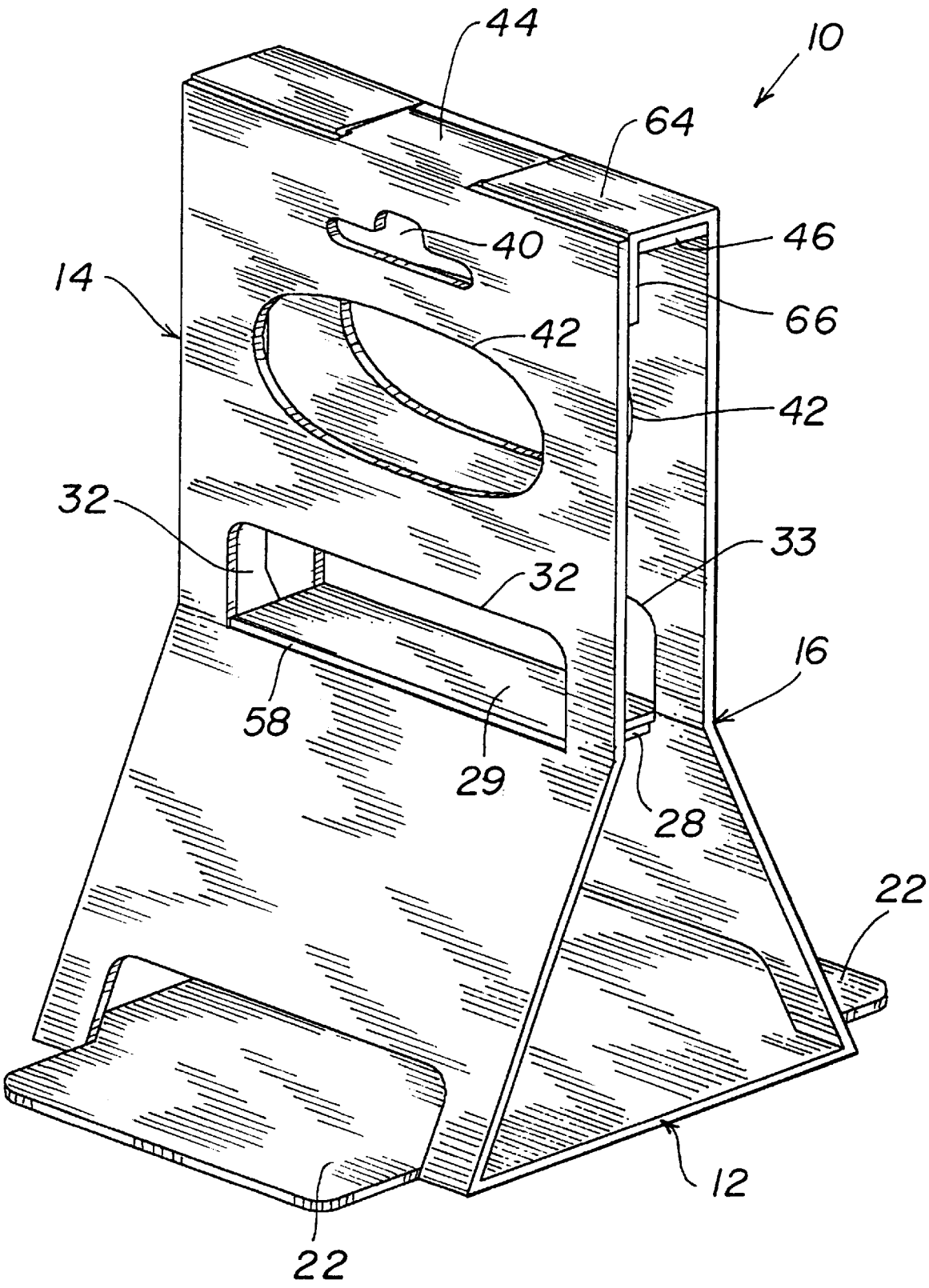
FIG. 3 is a perspective view of the carton of the invention after assembly without spurs.
Figure 4:
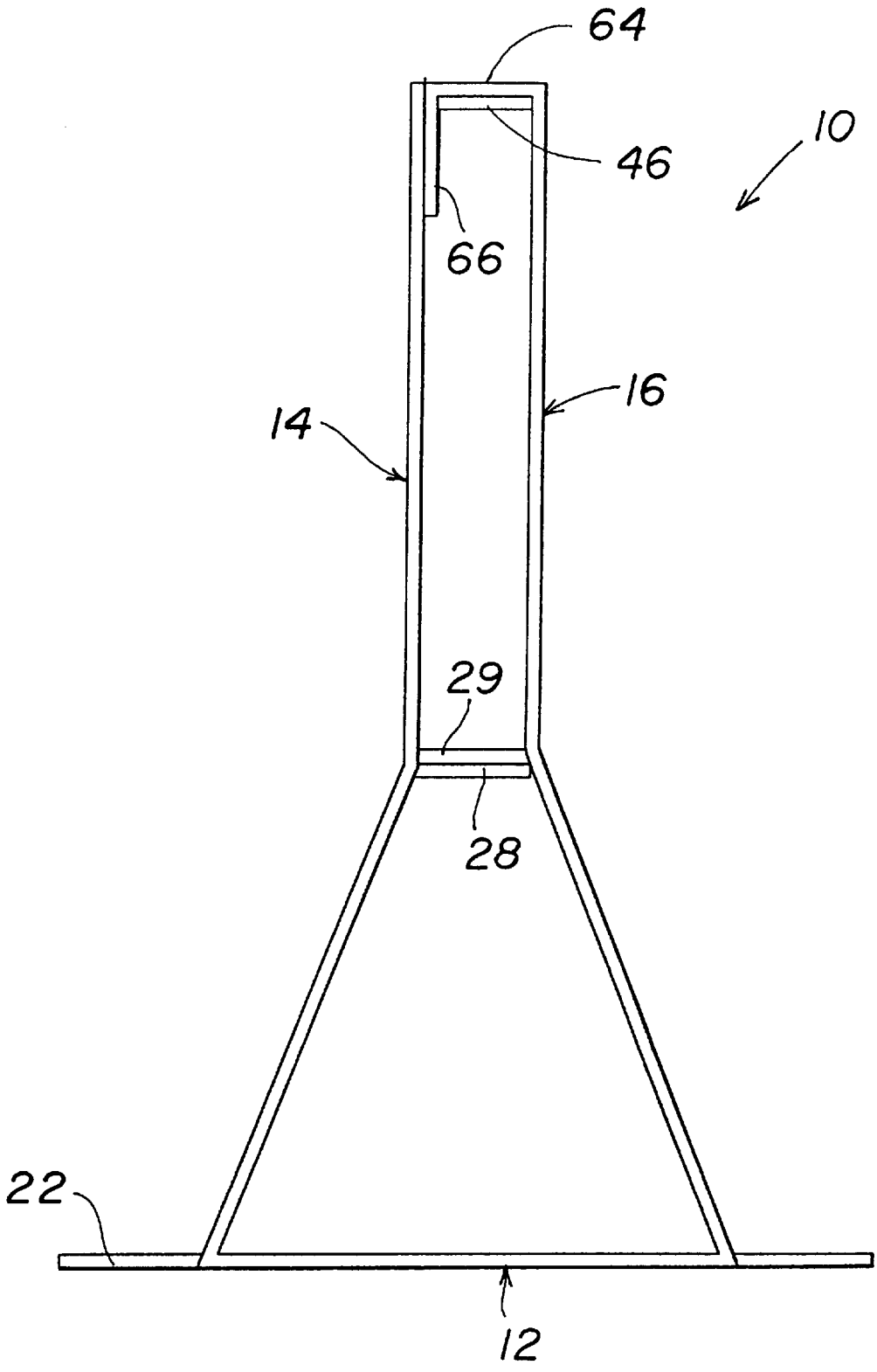
FIG. 4 is a side elevational view of the carton of FIG. 3.

The back section 16 of the carton 10 (seen as the top section in the plan view of the unfolded carton, FIG. 1) contains a substantially identical cut 18, tab 29, hanging slot 40, display opening 42, first folding lines 20, second folding line 30, and third folding lines 50. Therefore, the details of these features in the back section 16 are not repeated here. In the preferred embodiment, the height 36 of the tab 28 in the front section is slightly greater than the height 54 of the corresponding tab 29 in the back section (or vice versa), by an amount approximately equal to the thickness of the material utilized for the carton 10, so that the slight difference in the larger tab may be used to engage the opposite opening 32 during assembly, as seen in FIG. 2. The other difference between the front and back sections of the carton lies in their distal ends, where the back section contains a pair of foldable flaps 56 adapted to fold around and engage the wings 46 of the front section through the slits 48, thereby securely fastening the front and back sections 14, 16 and providing a reliable and quick mechanism to releasably assemble the carton 10. Fifth and sixth fold lines 58 and 60 are provided to effect the latching of the winged tab 44 by the foldable flaps 56. Note that since the winged tab 44 and the tabs 28, 29 define the distance between the upper portions of the front and back sections 14, 16, they should have approximately the same depth so as to produce parallel retaining structures around the necks and rowels of the spurs, as seen in FIG. 2. FIGS. 3 and 4 are perspective and side elevational views of the assembled carton of the invention to further illustrate its configuration (shown without the spurs).

Figure 5:
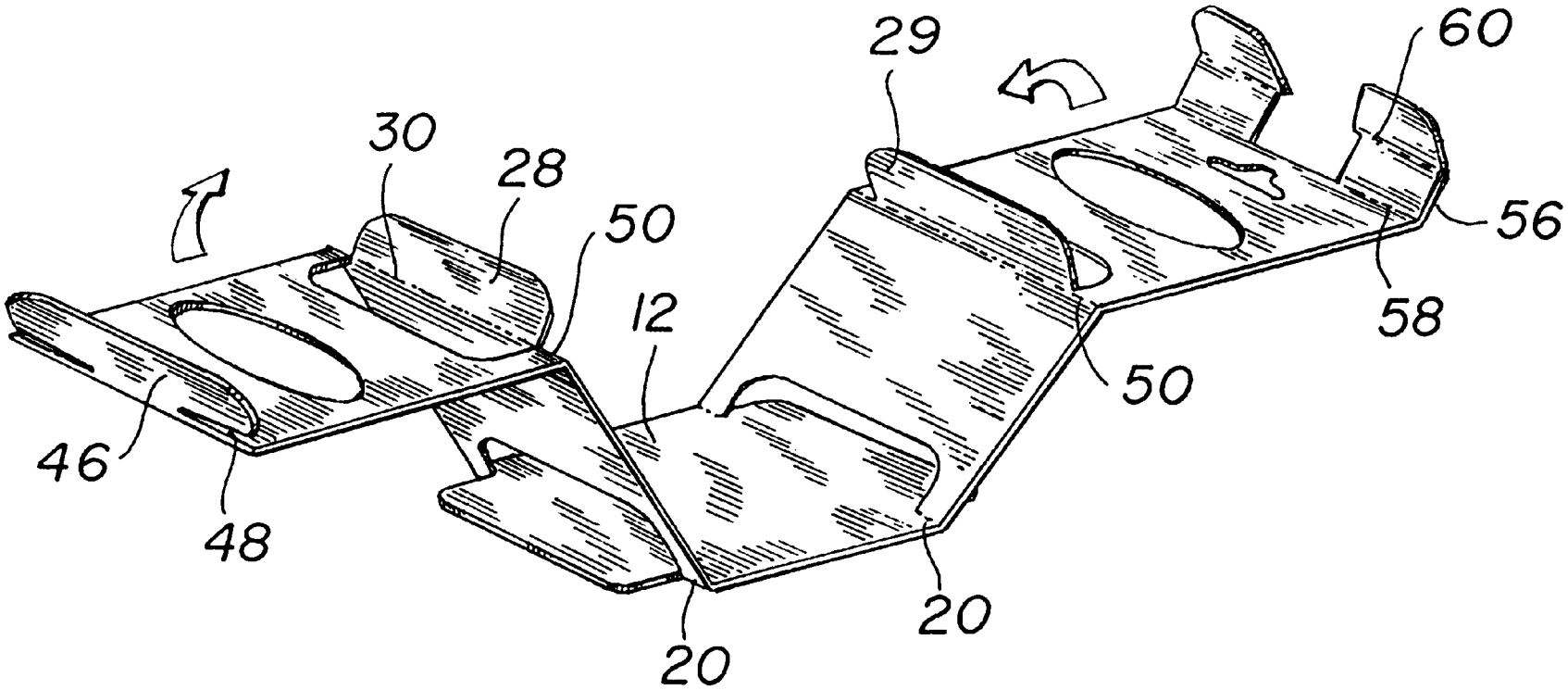
FIG. 5 is a perspective view of the carton of the invention illustrating the initial steps of folding the front and back sections upward to form the assembled unit of FIG. 3.

Following is a description of how the packaging carton 10 of the invention is wrapped around a pair of spurs to form a packaged item. As also illustrated by the intermediate configuration of FIG. 5, the front and back sections 14, 16 are first folded upward about 120 degrees along fold lines 20 to cause its bottom section 12 to produce a base for the package. While the sections are folded upward, the tabs 28, 29 are folded inward along fold lines 30 and the sides S of the spurs are passed through the resulting openings 32, 33. The front and back sections are then folded outward about 30 degrees along fold lines 50, so as to bring the top portions of the sections approximately in parallel to one another around the necks N and rowels R of the spurs, and the tabs 28, 29 are overlapped in substantial horizontal position to provide support to the spurs' shoulders H. The deeper tab 29 is placed on top of the tap 28 and its edge 58 is latched to the bottom of the opposite opening 32 to provide a stable connection between the two sections. The assembly is then completed by folding the flaps 56 first inward about 90 degrees along fold lines 58 and then downward 90 degrees along fold lines 60 and through the slits 48 in the front section, thereby hooking the wings 46 to secure an easily releasable engagement.

The enclosure so provided by the folded carton 10 around the pair of spurs can be used also to contain straps (not shown) that may accompany the spurs in the package. If present, the additional openings 42 render the neck portions of the spurs and any included straps visible in the package.

It is clear that the specific design of the packaging carton 10 must be tailored to the dimensions of the spurs for which it is intended. Thus, the placement of the openings 32, 33 must be at approximately the same distance from the bottom section 12 as the shoulders H of the spurs, and their dimensions must be such that the ends S and buttons B of the spurs can easily be passed through the openings. The length 24 of the base section 12 must be sufficient to accommodate the width of the spurs at the tips T. Similarly, the front and back sections must be sufficiently long to fully encase the spurs.

The resulting package, seen in FIG. 2, consists of two spurs securely and visibly contained within a carton 10 that can be hung on a display rack through the slot 40. Although loosely held, it is apparent that the spurs cannot be removed from the carton without first unlatching the flaps 56 from the slits 48 in the top of the package and unfolding the front and back sections 14, 16 to free the shoulders and the ends of the spurs. In order to further strengthen the package, it is possible to attach the two tabs 28, 29 and the interlocking flaps 56 and wings 46 either by gluing or stapling them together, but this step is not necessary to produce a well assembled package. In such case, the package could obviously not be readily disassembled.

In the preferred embodiment of the invention, shown in all figures, the carton 10 is made from a single piece of cardboard approximately 1 mm thick wherein all sections constitute an integral structure of unitary construction. In this embodiment, found to be suitable for many commercial spurs, the carton 10 is approximately 528 mm long and 90 mm wide throughout. The bottom section 12 is about 125 mm long and 90 mm wide, including extensions 22 that are about 20 mm deep and 70 mm wide disposed symmetrically with respect to both major and minor axes of the structure. The openings 32, 33 and corresponding tabs 28, 29 in the front and back sections 14, 16 are substantially the same size as the extensions 22, with slight variations to account for the thickness of the carton material in assembling a well fitted package. Thus, the tab 28 in the front section is 20 mm deep and placed at a distance 34 of 86 mm from the fold lines 20, while the tab 29 in the back section is 21 mm deep and placed at a distance 35 of 87 mm from its corresponding fold lines 20. The vertical (after assembly) portions of the front and back sections extending above fold lines 50 are 106 mm and 105 mm long, respectively, with a hanging slot placed at a distance 62 of about 20 mm from the top of each section. If provided, the display openings 42 are preferably rounded and placed between the tabs 28, 29 and the hanging slots 40.

The winged tab 44 attached to the front section 14 along fold line 52 is about 90 mm wide and 20 mm deep; each wing 46 is slightly tapered at the distal edge and is defined by a slit 48 that is 2 mm wide and 31 mm long. Each of the foldable flaps 56 attached to the back section 16 along fold lines 58 comprises a proximal portion 64 that is about 30 mm wide and 20 mm deep, and a distal portion 66 defined by fold lines 60. Each distal portion 66 is 19 mm deep and is 32 mm wide at the base and about 30 mm wide at the top, thereby having a slightly tapered inner edge that defines a catch 68 adapted to latch with the inner end of the corresponding slit 48 during assembly of the carton.

Various changes in the details, steps and components that have been described may be made by those skilled in the art within the principles and scope of the invention herein illustrated and defined in the appended claims. For example, the features of the front and back sides of the carton, as described, are obviously interchangeable because no distinguishable functional significance can be attributed to the front and back sections of the carton. Similarly, material other than cardboard could readily be used so long as sufficiently rigid to provide support to the carton and suitable for bending along designated fold lines.

Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A foldable carton for packaging a pair of western spurs each having a wishbone structure that includes a U-shaped heel band with substantially straight, spaced-apart first and second ends and a neck protruding outwardly from the heel band, each of said first and second ends including a corresponding tip facing a direction opposite to said neck, the carton comprising:

a bottom section of unitary construction;

a front section defining a front fold line with the bottom section and containing a front opening adapted to receive the first ends of said pair of spurs;

a back section defining a back fold line with the bottom section and containing a back opening adapted to receive the second ends of said pair of spurs;

a front extension of said bottom section projecting forward from the front fold line, said front extension being sufficiently large for the first ends of the spurs to be placed thereon;

a back extension of said bottom section projecting backward from the back fold line, said back extension being sufficiently large for the second ends of the spurs to be placed thereon; and latch means for fastening the front and back sections after each section has been folded upward with respect to the bottom section, the first and second ends of the spurs have been passed through the front and back openings, respectively, and the tips of said first and second ends of the spurs have been placed over said extensions of the bottom section.

2. The carton of claim 1, further including a front hanging slot in the front section and a back hanging slot in the back section for receiving a hook of a display rack.

3. The carton of claim 2, further comprising a front display opening in the front section and a back display opening in the back section.

4. The carton of claim 3, wherein said front and back openings, said front and back hanging slots, and said front and back display openings are substantially symmetrical with respect to the bottom section.

5. The carton of claim 2, wherein said front and back openings and said front and back hanging slots are substantially symmetrical with respect to the bottom section.

6. The carton of claim 1, wherein said front extension consists of a front tab formed by a front cut defining a front opening abutting the front fold line in the front section and said back extension consists of a back tab formed by a back cut defining a back opening abutting the back fold line in the back section.

7. The carton of claim 1, further comprising a front foldable tab defined by the front opening and a back foldable tab defined by the back opening, said tabs being adapted to overlap after the front and back sections have been folded upward to provide a spacing between the sections and a support for the heel bands of the spurs.

8. The carton of claim 1, further comprising a front display opening in the front section and a back display opening in the back section.

9. The carton of claim 1, wherein said front and back openings are substantially symmetrical with respect to the bottom section.

10. The carton of claim 1, wherein said latch means consists of a winged tab attached to the front section and a foldable flap attached to the back section.

11. The carton of claim 1, further including a front hanging slot in the front section and a back hanging slot in the back section for receiving a hook of a display rack; including a front foldable tab defined by the front opening and a back foldable tab defined by the back opening, said tabs being adapted to overlap after the front and back sections have been folded upward to provide a spacing between the sections and a support for the heel bands of the spurs; and including a front display opening in the front section and a back display opening in the back section;

wherein said front and back openings, said front and back hanging slots, and said front and back display openings are substantially symmetrical with respect to the bottom section;

wherein said bottom section comprises two extensions adapted to support said ends of the pair of spurs; and wherein said latch means consists of a winged tab attached to the front section and a foldable flap attached to the back section.

12. The carton of claim 11, wherein said bottom, front and back sections and said latch means consist of a unitary piece of material.

13. The carton of claim 12, wherein said material is cardboard.

14. The carton of claim 1, wherein said bottom, front and back sections and said latch means consist of a unitary piece of material.

15. The carton of claim 1, wherein said latch means consists of a winged tab attached to the back section and a foldable flap attached to the front section.

16. The carton of claim 1, further including a front hanging slot in the front section and a back hanging slot in the back section for receiving a hook of a display rack; including a front foldable tab defined by the front opening and a back foldable tab defined by the back opening, said tabs being adapted to overlap after the front and back sections have been folded upward to provide a spacing between the sections and a support for the heel bands of the spurs; and including a front display opening in the front section and a back display opening in the back section;

wherein said front and back openings, said front and back hanging slots, and said front and back display openings are substantially symmetrical with respect to the bottom section;

wherein said bottom section comprises two extensions adapted to support said ends of the pair of spurs; and wherein said latch means consists of a winged tab attached to the back section and a foldable flap attached to the front section.

* * * * *